US006726310B1

(12) United States Patent
Hawkins et al.

(10) Patent No.: US 6,726,310 B1
(45) Date of Patent: Apr. 27, 2004

(54) PRINTING LIQUID DROPLET EJECTOR APPARATUS AND METHOD

(75) Inventors: Gilbert A. Hawkins, Mendon, NY (US); Edward P. Furlani, Lancaster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/294,219

(22) Filed: Nov. 14, 2002

(51) Int. Cl.[7] ..... B41J 2/04; B41J 2/06
(52) U.S. Cl. ..... 347/54; 347/55
(58) Field of Search ..... 347/54, 55, 62, 347/65, 66, 67, 68, 75; 399/243

(56) References Cited

U.S. PATENT DOCUMENTS

| | | | | |
|---|---|---|---|---|
| 5,599,695 | A | 2/1997 | Pease et al. | 435/91.1 |
| 5,644,341 | A | 7/1997 | Fujii et al. | 347/11 |
| 5,668,579 | A | 9/1997 | Fujii et al. | 347/10 |
| 5,739,831 | A | 4/1998 | Nakamura et al. | 347/51 |
| 5,771,882 | A | 6/1998 | Psaros et al. | D8/203.12 |
| 5,880,752 | A | 3/1999 | Weber et al. | 347/15 |
| 5,902,648 | A | 5/1999 | Naka et al. | 427/558 |
| 6,067,797 | A | 5/2000 | Silverbrook | 60/528 |
| 6,102,530 | A | 8/2000 | Kim et al. | 347/65 |
| 6,127,198 | A | 10/2000 | Coleman et al. | 438/21 |
| 6,130,689 | A * | 10/2000 | Choi | 347/54 |
| 6,234,609 | B1 | 5/2001 | Silverbrook | 347/54 |
| 6,239,821 | B1 | 5/2001 | Silverbrook | 347/54 |
| 6,243,113 | B1 | 6/2001 | Silverbrook | 347/54 |
| 6,254,793 | B1 | 7/2001 | Silverbrook | 347/54 |
| 6,274,056 | B1 | 8/2001 | Silverbrook | 347/54 |
| 6,318,841 | B1 | 11/2001 | Coleman et al. | 347/44 |
| 6,345,884 | B1 | 2/2002 | Yoon et al. | 347/54 |
| 6,357,865 | B1 | 3/2002 | Kubby et al. | 347/68 |
| 2001/0023523 | A1 | 9/2001 | Kubby et al. | 29/25.35 |

* cited by examiner

*Primary Examiner*—Juanita Stephens
(74) *Attorney, Agent, or Firm*—Roger A. Fields

(57) ABSTRACT

In a printing liquid droplet ejector, a liquid holding unit in a cavity has a volume sufficient to hold some of the printing liquid in the cavity and is mechanically translatable toward an opening in a nozzle. The liquid holding unit is volumetrically alterable to reduce its volume to cause at least some of the printing liquid held by the unit to be expelled from the unit, to in turn cause either printing liquid expelled from the unit or other printing liquid in the cavity to be ejected from the opening as at least one droplet, when the unit is mechanically translated toward the opening.

18 Claims, 16 Drawing Sheets

PRINTING LIQUID DROPLET EJECTOR APPARATUS AND METHOD

FIELD OF THE INVENTION

The invention relates generally to printing liquid droplet ejectors such as used in ink jet printers, and in particular to an ejector in which a printing liquid is ejected from an opening in a nozzle as at least one droplet.

BACKGROUND OF THE INVENTION

Ink droplet ejectors for use in ink jet printers are generally know. Printheads employing thermal bubble jet and piezo droplet ejectors to eject successive droplets of ink from a droplet ejection opening have found substantial commercial success. Recently, other classes of ink droplet ejectors have been become known, including those based on the motion of a mechanical piston or diaphragm. Known ejectors of this type include a cavity for containing the ink, a nozzle plate having a droplet ejection opening at the cavity, and a piston or diaphragm which can be moved or translated in the cavity to eject successive droplets of the ink from the opening. The motive force translating the piston or diaphragm is typically provided from thermal bimorphs, piezo-electric bimorphs, electrostatic membranes, magnets, etc.

For example, prior art U.S. Pat. No. 5,644,341 issued Jul. 1, 1997 discloses that the diaphragm is first distorted and then relaxed, by means of an electrostatic charge having successive different voltages, to eject the ink droplets. Also, see prior art U.S. Pat. No. 6,357,865 B1 issued Mar. 19, 2002.

Instead of a diaphragm, prior art U.S. Pat. No. 6,318,841 B1 issued Nov. 20, 2001 discloses that a so-called "piston layer" can be used, which is moved towards the opening in the nozzle plate to eject the ink droplets when an electrical field is applied between the piston layer and the nozzle plate.

Another substitute for the diaphragm is disclosed in prior art U.S. Pat. No. 6,234,609 B1 issued May 22, 2001. In this instance, a so-called "ejection paddle" is translated mechanically or pivoted towards the opening in the nozzle to eject the ink droplets when a thermal actuator for the ejection paddle is pivoted away from the opening. The motive force translating or pivoting the "ejection paddle" is provided by a thermal bimorph.

In all cases, it appears that the ink is ejected from the droplet ejection opening when the diaphragm, piston or the like is actuated within the cavity. Moreover, prior to the next actuation, the ink refills the cavity via a connection to an ink reservoir.

An important parameter regarding the actuation is the volumetric efficiency of the printhead, as discussed by Gooray et.al. in the Journal of Imaging Science and Technology, Vol. 46, No. 5, published September/October 2002. The volumetric efficiency characterizes the ratio of the volume of liquid ejected to the volume of liquid returned to the reservoir, or, for droplet ejectors in which a diaphragm is moved, the volumetric efficiency also characterizes the ratio of the volume of liquid ejected to the volume swept out by the motion of the diaphragm. If the volumetric efficiency is low, the energy required to eject a droplet is large, leading to an excessive generation of heat. Additionally, if the volumetric efficiency is low, the volume of the ejected droplet and the velocity of the ejected droplet may be reduced, all of which are well known in the art of inkjet printing to be undesirable.

Prior art U.S. Pat. No. 6,102,530, issued Aug. 15, 2000, discloses multiple thermal means for heating ink near the ejection opening prior to droplet ejection. Such heating generally increases volumetric efficiency, since the heated liquid near the ejection opening flows more readily and since a secondary bubble occludes a refill channel during drop ejection. However, additional heating pulses consume power. Prior art U.S. Pat. No. 5,880,752, issued Mar. 9, 1999, discloses active valves, for example bimetallic valves, separating the ink cavity from the reservoir. When such valves are closed during droplet ejection, the volumetric efficiency is increased. However, the complexity of building valves increases the cost of droplet ejectors.

For the case of a "piston layer," as described in the above-mentioned prior art U.S. Pat. No. 6,318,841 B1, the volumetric efficiency may be controlled by locating the edge of the piston layer precisely in relation to the inner surface of the ink cavity. If the edge and the surface are closely located, the connection between the ink cavity and the reservoir impedes the ink flow, and the volumetric efficiency is large. However, since the ink cavity must be refilled through the connection, the actuation frequency of the droplet ejector will be small, which reduces printing productivity, as is well known in the art. Thus, the volumetric efficiency must be compromised to maintain a high actuation frequency.

In light of the above, it is desirable to provide a droplet ejector with increased volumetric efficiency without increasing its cost and without decreasing its frequency of actuation. This is believed to be accomplished by the invention, in several embodiments to be described.

SUMMARY OF THE INVENTION

According to one aspect of the invention, a printing liquid droplet ejector, comprises:

- a cavity for containing a printing liquid;
- a nozzle having a droplet ejection opening at the cavity;
- a liquid holding unit in the cavity having a volume sufficient to hold some of the printing liquid in the cavity, being mechanically translatable toward the opening, and being volumetrically alterable to reduce its volume to cause at least some of the printing liquid held by the unit to be expelled from the unit to in turn cause either printing liquid expelled from the unit or other printing liquid in the cavity to be ejected from the opening as at least one droplet when the unit is mechanically translated toward the opening; and
- a force applying device for applying a motive force to the liquid holding unit to mechanically translate the unit towards the opening and volumetrically alter the unit to reduce its volume.

According to another aspect of the invention, a method of ejecting printing liquid as one or more droplets using a liquid holding unit that is volumetrically alterable to reduce its volume to expel a printing liquid held by the unit, comprises:

- placing a printing liquid into a cavity including a nozzle having a droplet ejection opening; and
- applying a motive force to the liquid holding unit in the cavity to mechanically translate the unit towards the opening and, when the unit is at least close to the opening, to volumetrically alter the unit to reduce its volume so that either printing liquid expelled from the unit or other printing liquid in the cavity is ejected from the opening as at least one droplet.

BRIEF DESCRIPTION OF THE DRAWINGS

FIG. 2 is a cross-sectional view of the ejector in FIG. 1, when the liquid holding unit has been translated upwards and the bottom base has been deformed from an original substantially convex exterior condition bulging-out as in FIG. 1 to an changed substantially concave exterior condition bulging-in;

DETAILED DESCRIPTION OF THE INVENTION

Figure 1:
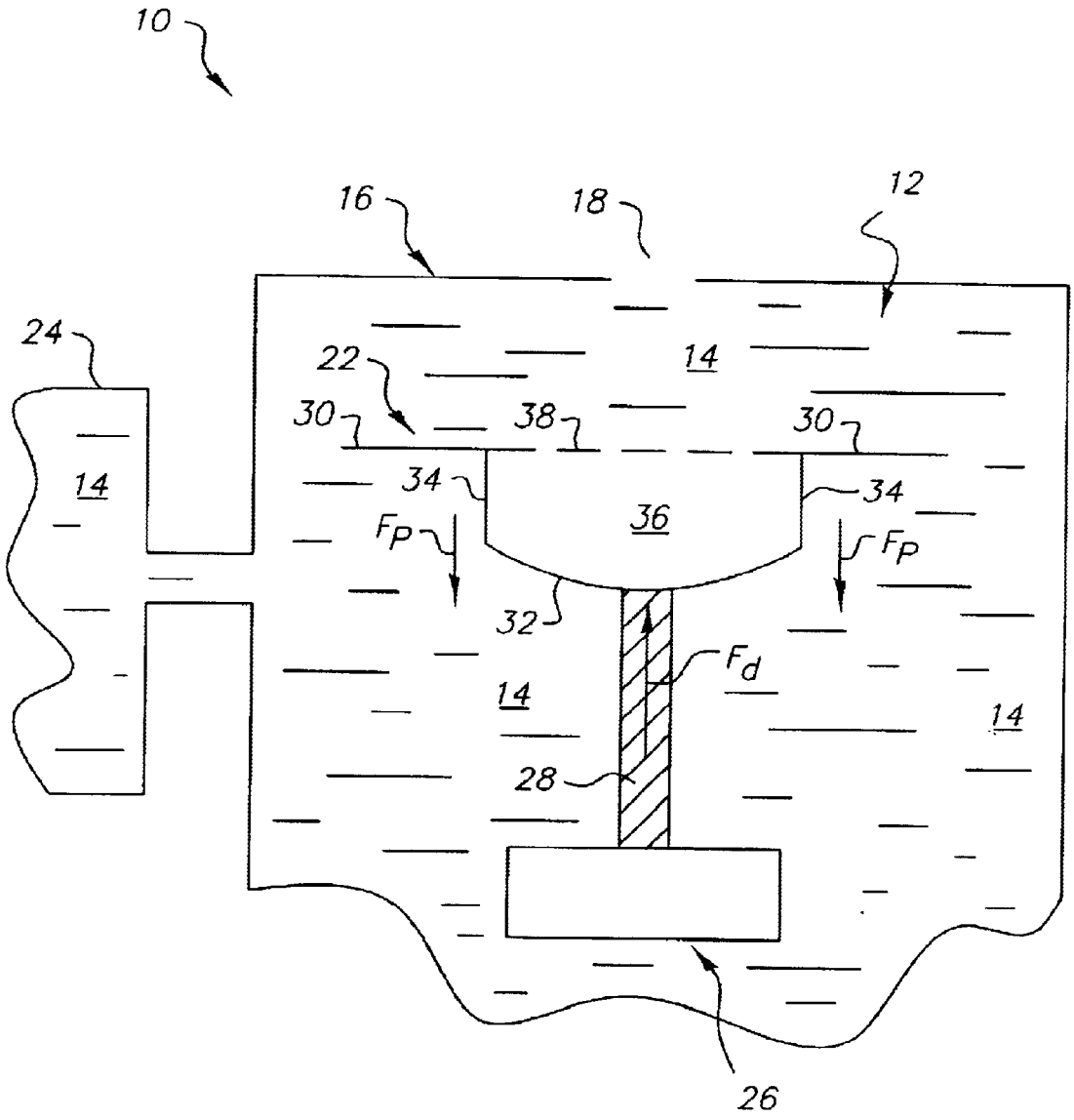
FIG. 1 is a cross-sectional view of a printing liquid droplet ejector according to a preferred embodiment of the invention, including a liquid holding unit having a top plate, sidewall, and a bottom base such as a deformable bowl-like diaphragm.
Figure 2:
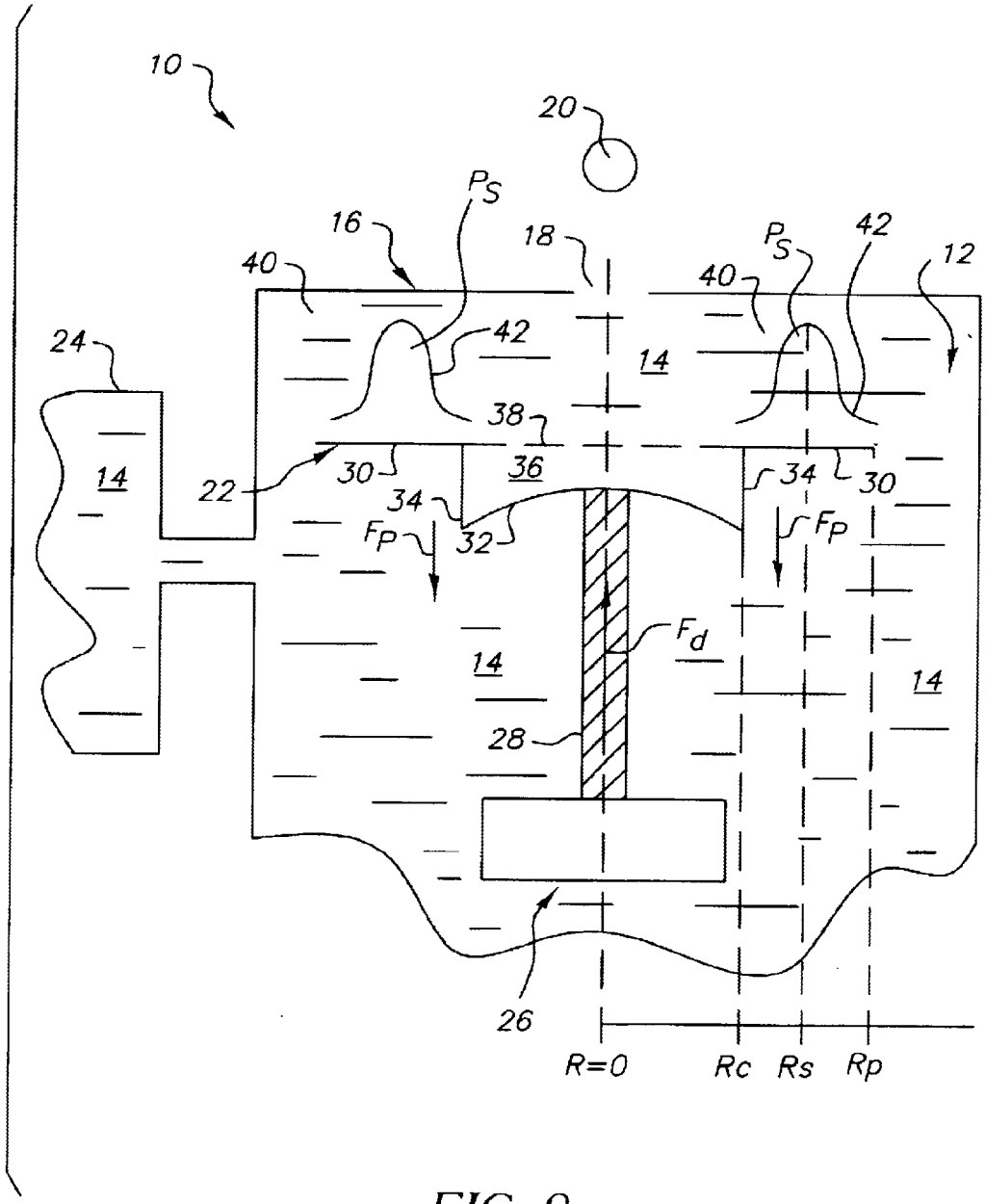

FIGS. 1 and 2 are a cross-sectional view of an axisymmetric, i.e. a cylindrically symmetric, printing liquid droplet ejector 10. The ejector 10 comprises:

- a cylindrical cavity 12 for containing a known printing liquid or ink 14;
- a nozzle 16, preferably a round plate, secured on top of the cavity 12 to cover the cavity, and having a centered droplet ejection opening or orifice 18 from which successive droplets 20 (only one shown in FIG. 2) of the printing liquid 14 are ejected;
- a liquid holding unit 22, preferably a bowl-like diaphragm, located in the cavity 12 below the droplet ejection opening 18;
- a reservoir supplier 24 of the printing liquid 14 in a liquid communication with the cavity 12 to continually replenish or fill the cavity; and
- a known force applying device 26 including a mechanically translatable pusher or shaft 28 connected to the liquid holding unit 22 for applying a motive force, indicated by an arrow $F_d$, for mechanically translating the unit vertically in the cavity 12 as can be seen by comparing FIGS. 1 and 2.

The liquid holding unit 22 integrally includes an annular top plate 30, a deformable elastomeric bottom base 32, a continuous sidewall 34 which with the bottom base defines an interior volume 36 of the unit that is sufficient to hold some of the printing liquid 14 in the cavity 12. In other words in FIG. 1, should the printing liquid 14 in the cavity 12 be drained from the bottom of the cavity, the remaining liquid held by the combination of the base 32 and the sidewall 34 would completely fill the interior volume 36 to the broken fill-line 38 as indicated in FIG. 1.

The bottom base 32 is deformable between two quasistable structural configurations or conditions, an original substantially convex exterior condition bulging-out in FIG. 1 and a changed substantially concave exterior condition bulging-in in FIG. 2. The deformation of the bottom base 32 from its original substantially convex exterior condition bulging-out in FIG. 1 to its changed substantially concave exterior condition bulging-in in FIG. 2, constitutes a volumetric alteration of the liquid holding unit 22 that reduces the interior volume 36 of the unit. This causes some of the printing liquid 14 held within the bottom base 32 and the sidewall 34 to the broken fill-line 38' (FIG. 2), to be expelled from within the bottom base and the sidewall.

If the bottom base 32 was deformed only to an intermediate configuration or condition between its original substantially convex exterior condition bulging-out in FIG. 1 and its changed substantially concave exterior condition bulging-in in FIG. 2, the bottom base would be sufficiently unstable in the intermediate configuration so that it would spontaneously or inherently go on to deform further to either of its quasistable conditions in FIGS. 1 and 2. This is consistent with a well known principle of bistable elasticity in the field of mechanical engineering.

The bottom base 32 is deformed from its original substantially convex exterior condition bulging-out in FIG. 1 to its changed substantially concave exterior condition bulging-in in FIG. 2, when the motive force $F_d$ is applied via the pusher 28 to the bottom base to mechanically translate the liquid holding unit 22 upward, and the unit is raised to be at least close to the nozzle 16 as can be seen in FIG. 2. In FIG. 2, there is a stratum or thin layer 40 of printing liquid 14 between the top plate 30 (of the liquid holding unit 22)

and the nozzle plate 16. However, the liquid holding unit 22 can be raised further so that the top plate 30 contacts the nozzle plate 16. As the bottom base 32 is deformed from its original substantially convex exterior condition bulging-out as in FIG. 1 to its changed substantially concave exterior condition bulging-in in FIG. 2, the resulting volumetric alteration that reduces the interior volume 36 of the liquid holding unit 22 causes some of the printing liquid 14 held within the bottom base and the sidewall 34 to be expelled. Then, either the expelled liquid or other printing liquid 14 in the cavity 12 is ejected from the opening 18 as at least one droplet 20.

As the liquid holding unit 22 is mechanically translated upward in FIG. 2 by the pusher 28, an opposing or reacting force $F_p$ is transmitted from the top plate 30, along the sidewall 34, to the bottom base 32. As would be understood by one of ordinary skill in the art, the opposing force $F_p$ arises principally from a liquid pressure exerted on the top plate 30. When the opposing force $F_p$ exceeds a certain threshold force $F_c$ in FIG. 3, the bottom base 32 is deformed from its original substantially convex exterior condition bulging-out in FIG. 1 to its changed substantially concave exterior condition bulging-in in FIG. 2. The precise value of the threshold force $F_c$ depends very weakly on the acceleration of the liquid holding unit and the printing liquid in the cavity, as noted later, but this effect is not large.

Operation

The operation of the printing liquid droplet ejector 10 is as follows. Initially, the motive force $F_d$ is applied via the pusher 28 to the bottom base 32 as shown in FIG. 1. This causes the entire liquid holding unit 22 to be mechanically translated upward towards the nozzle plate 16 in FIG. 2, and so that the bottom base 32 is deformed from its original substantially convex exterior condition bulging-out in FIG. 1 to its changed substantially concave exterior condition bulging-in in FIG. 2. Consequently as stated before, a droplet 20 is ejected from the opening 18.

Although the motive force $F_d$ is described as being applied to the bottom base 32 via the pusher 28, it can be applied by various other known means which, for example, include electrostatic or thermal-elastic actuation means.

As the liquid holding unit 22 is mechanically translated upward in FIG. 2 towards the nozzle plate 16, it gives rise to a pressure distribution in the stratum 40 of printing liquid 14 between the top plate 30 and the nozzle plate which relates to the opposing $F_p$. The opposing $F_p$ may be calculated as follows.

In FIG. 2, r=0 represents a vertical centerline of the ejector 10, $r_c$ represents the radius of the sidewall 34, and $r_p$ represents the radius of the top plate 30. A pressure P developed on the bottom base 32 is $$p=p_B(v,h,r_c,r_p,\mu), \tag{1}$$

which is substantially independent of r, and a pressure over the top plate 30 ($r_c<r<r_p$), known as the "squeeze-film pressure" in the stratum 40, is $$p(r) = -\frac{3\mu v}{h^3}r^2 + C_1(r_c, r_p, \mu)\ln(r) + C_1(r_c, r_p, \mu) \tag{2}$$

which depends strongly on r. In these equations, $P_B$ is the Bernoulli pressure, r is a variable radius, v is the velocity of the liquid holding unit 22, h is the distance between the nozzle plate 16 and the top plate 30, $\mu$ is the viscosity of the printing liquid 14, and C1 is a constant. The equation (2) is based on a Reynolds lubrication theory in which the pressure p(r) is given by the following equation $$\frac{1}{r}\frac{\partial}{\partial r}\left(r\frac{\partial p(r,t)}{\partial r}\right) = -\frac{12\mu}{h^3}v(t). \tag{3}$$

Equation (2) is a well-known solution of (3). The Reynolds lubrication theory applies for a low Reynolds number, laminar flow of a relatively thin film of liquid, and applies to the stratum 40. The squeeze-film pressure derives solely from the liquid viscosity $\mu$.

The squeeze-film pressure is distributed as shown by a curve 42 in FIG. 2. Specifically, it has a peak value $p_s$ (squeeze-film pressure) that occurs at a position called the squeeze-film radius $r_s$. The horizontal velocity of the printing liquid 14 is zero at this position. As long as $p_s$ is sufficiently high (i.e., substantially greater than the minimum pressure required to cause printing liquid ejection through the opening 18), the printing liquid within the squeeze-film radius $r_s$ will be forced out of the opening 18 as an ejected droplet 20 in FIG. 2, and the printing liquid outside this radius will flow back into the reservoir supplier 24.

The opposing force $F_p$ on the top plate 30 due to the squeeze-film pressure distribution is $$F_p = 2\pi\int_{r_c}^{r_p} p(r)r\,dr, \tag{4}$$

This force resists the upward motion of the top plate 30 in FIG. 2 as the top plate nears the nozzle plate 16.

The total downward force on the liquid holding unit 22 in FIGS. 1 and 2, $F_f(t)$, differs from the force $F_p$ by additional forces $F_a$ arising from inertial effects, i.e. the acceleration and motion of the printing liquid 14 at all locations in the cavity 12, so that $$F_f=F_p+F_a \tag{5}$$

It is useful to distinguish the force terms in equation (5) because the squeeze-film pressure changes rapidly and becomes dominant as the liquid holding unit 22 moves close to the nozzle plate 16 because of the term h in the denominator of equation (2), and is responsible for causing the bottom base 32 to deform from its original substantially convex exterior condition bulging-out in FIG. 1 to its changed substantially concave exterior condition bulging-in FIG. 2.

Figure 3:
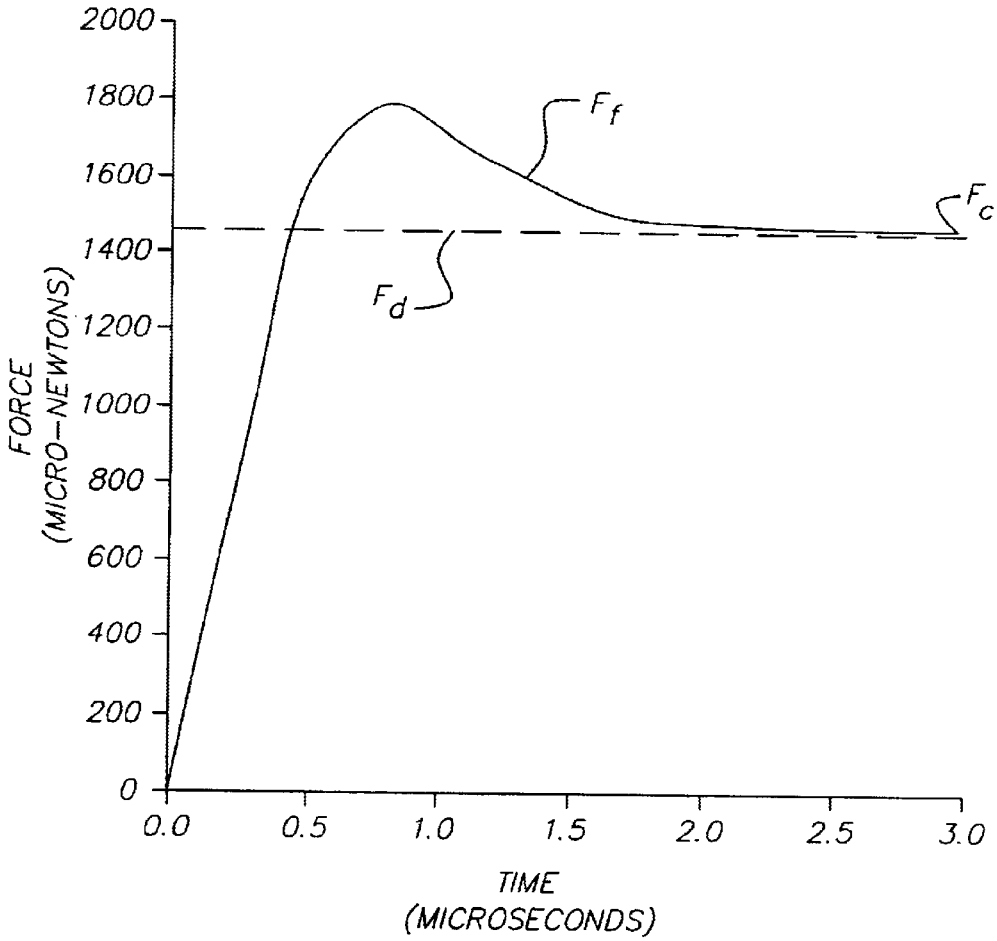
FIG. 3 shows analytic calculations of the magnitudes of a motive force and a liquid force applied to the liquid holding unit as a function of time.

As the liquid holding unit 22 accelerates towards the nozzle plate 16, the force $F_p$ increases due to the squeeze-film pressure until it exceeds the threshold force $F_c$. A typical plot of $F_p$ and $F_d$ is shown in FIG. 3. In this plot, $F_d$ is held constant at a value equal to the threshold force $F_c$. $F_p$ is seen to steadily increase until it equals $F_c$, principally due to the increase in squeeze-film pressure as the liquid holding unit 22, in particular the top plate 30, is moved by the motive force $F_d$ into a proximity of the nozzle plate 16. When this occurs, some of the printing liquid held by the liquid holding unit 22 is expelled by the deformation of the bottom base 32 from its original substantially convex exterior condition bulging-out in FIG. 1 to its changed substantially concave exterior condition bulging-in in FIG. 2, and then the expelled liquid or other printing liquid in the cavity 12 is ejected through the opening 18 as a droplet 20 (which increases both the volume and the velocity of the droplet as will be discussed). This is one of the key advantages of the invention. The force $F_f$ eventually exceeds $F_d$ and acts to decelerate and stop the liquid holding unit 22 at the final stage of droplet ejection.

Figure 4:
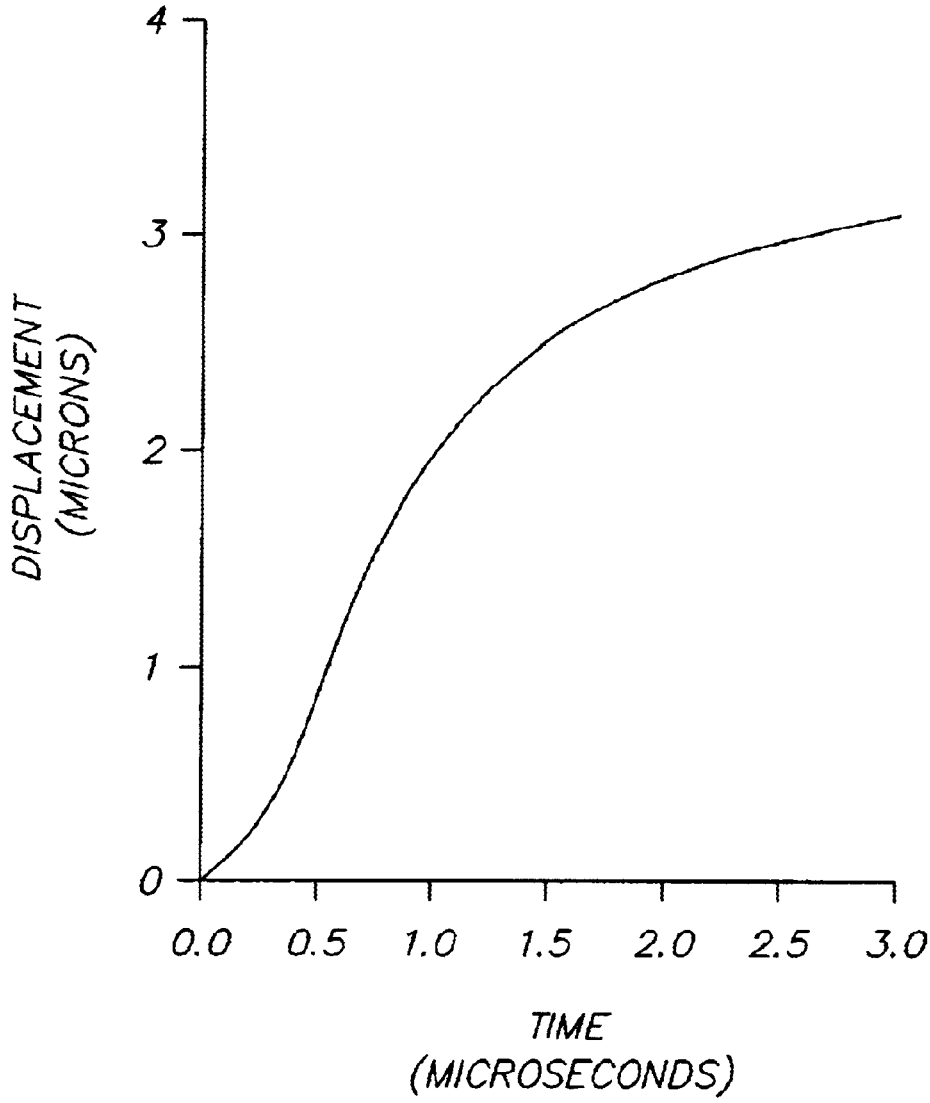
FIG. 4 shows the motion of the liquid holding unit as a function of time.

The motion of the liquid holding unit 22 is shown in FIG. 4 as a function of time. It is clear from FIG. 4 that squeeze-film damping builds in time to limit the approach of the liquid holding unit 22 toward the nozzle plate 16.

As a result of the deformation of the bottom base 32 from its original substantially convex exterior condition bulging-out in FIG. 1 to its changed substantially concave exterior condition bulging-in in FIG. 2, the volume and the velocity of the droplet 20 are increased relative to the values they would have in the absence of the deformation of the bottom base. This increase in the volume and the velocity of the droplet 20 can be understood by approximating the acceleration of the liquid holding unit 22 as $$M_{eff}\frac{d^2 y_p}{dt^2} = F_d - F_f(t), \tag{6}$$

where $M_{eff}$ is the effective mass of the liquid holding unit 22 and the printing liquid 14 that it accelerates. If a fraction a of the volume of the printing liquid 14 displaced by the liquid holding unit 22 exits the opening 18 then the liquid flow rate through the opening 18 is $$Q_o(t)=\alpha A_p v_p(t)+Q_{st}(t) \tag{7}$$

where $A_p$ is the surface area of the liquid holding unit 22, and $$Q_{st}(t) = \begin{cases} V_{st}(t)/\tau_{st} & \tau_a < t < \tau_a + \tau_{st} \\ 0 & t < \tau_a \text{ and } \tau_a + \tau_{st} < t \end{cases} \tag{8}$$

where $V_{st}$ (t) is the volume of the printing liquid 14 displaced by the bottom base 32 as it deforms its original substantially convex exterior condition bulging-out in FIG. 1 to its changed substantially concave exterior condition bulging-in in FIG. 2, $\tau_a$ is the time at which the deformation occurs, and $\tau_{st}$ is the duration of the deformation. This assumes that the squeeze-film pressure is sufficiently high so that the reduction of the interior volume 36 of the liquid holding unit 22 constitutes the liquid volume ejected from the opening 18. Thus, the velocity of the droplet 20 can be estimated using $$V_{drop} = \frac{\int_0^{\tau_d} Q_o(t)v_0(t)dt}{\int_0^{\tau_d} Q_o(t)dt}, \tag{9}$$

where $v_0$ (t)=$Q_0$ (t)/$A_0$, and $A_0$ is the area of the opening 18. Using the modeled values of F(t) from FIG. 3, the velocity of the droplet ejection may be plotted as a function of the $\tau_a/\tau_d$ as shown in FIG. 5.

Figure 5:
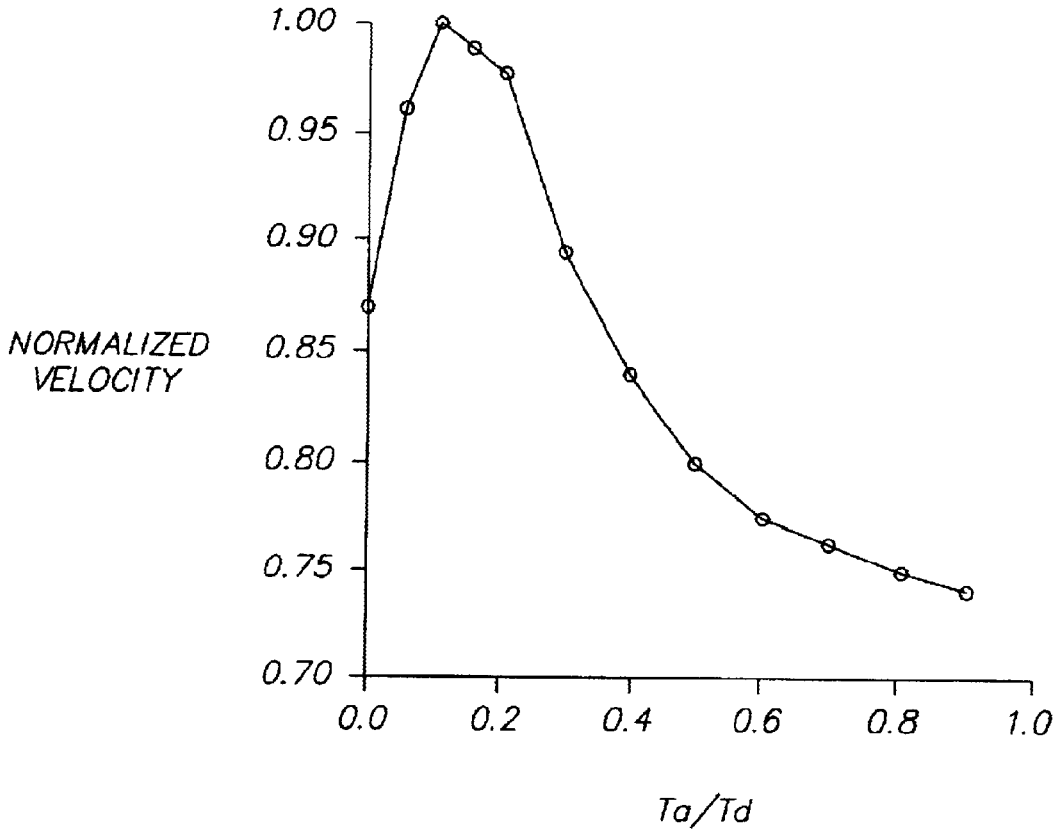
FIG. 5 shows a normalized drop velocity of printing liquid droplets ejected from the ejector of FIGS. 1 and 2 as a function of the ratio of the time, $\tau_a$, at which deformation of the bottom base from its original substantially convex exterior condition bulging-out as in FIG. 1 to its changed substantially concave exterior condition bulging-in in FIG. 2 occurs, to the time $T_d$, at which a droplet is separated from the printing liquid.

In FIG. 5, the ratio $\tau_a/\tau_d$ depends on design parameters, such as the geometry and material elasticity of the liquid holding unit 22, and on liquid parameters, such as liquid density and viscosity of the printing liquid 14. By designing the liquid holding unit 22 so that $\tau_a/\tau_d$ is about 0.1, the velocity of the droplet 20 is maximized.

If the design results in a deformation of the bottom base 32 from its original substantially convex exterior condition bulging-out in FIG. 1 to its changed substantially concave exterior condition bulging-in in FIG. 2 that occurs prematurely, the bottom base can be re-designed by making the liquid holding unit 22 from a material having a higher elastic constant so as to require a higher force for deformation of the bottom base. It is an advantage in accordance with the invention that the liquid holding unit 22 is designed to effect deformation of the bottom base 32 at a time which optimizes the droplet velocity.

The existence of the maxima in droplet velocity as a function of the design of the liquid holding unit 22 in FIGS. 1 and 2, as quantitatively modeled above, is quite general, requiring only that the force $F_f$ increases approximately linearly with time over a portion of the motion of the unit preceding droplet ejection. That this a general result can be seen analytically by assuming an approximate behavior for $F_f$ expected to be generally representative of $F_f$ during the onset of squeeze film damping for a variety of driving forces Fd which push the liquid holding unit 22 into proximity with the nozzle plate 16. In this case, $F_f$ can be approximated analytically as $$F_f(t) = 2\frac{t}{\tau_d}F_d \tag{10}$$

Figure 6:
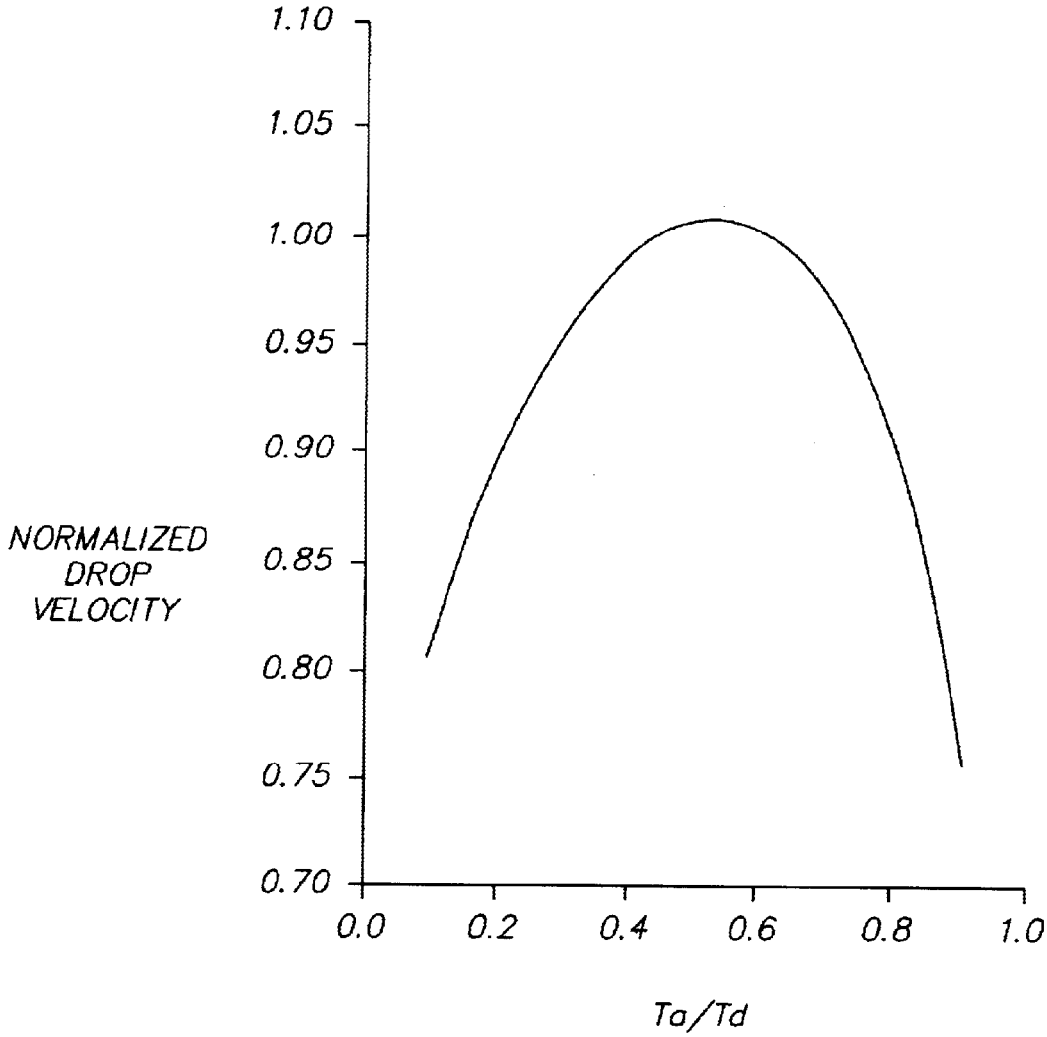
FIG. 6 shows the normalized drop velocity of printing liquid droplets ejected from a typical ejector as a function of the ratio of the time, $\tau_a$, at which deformation of the bottom base from its original substantially convex exterior condition bulging-out in FIG. 1 to its changed substantially concave exterior condition bulging-in in FIG. 2 occurs, to the time, $T_d$, at which a droplet is separated from the printing liquid.

Using equation 10, it follows immediately from equations (6)–(11) that the velocity of the liquid holding unit 22 is given by $$v_p(t) = \frac{F_f t}{M_{eff}}\left(1 - \frac{t}{\tau_d}\right), \tag{11}$$

where $\tau_d$ is the total time to eject the droplet 20, as graphed in FIG. 6. This more general plot shows that, for a wide variety of conditions of applied forces, there is an optimum time $\tau_a$ at which the deformation of the bottom base 32 should be initiated to render the maximum droplet velocity.

As readily understood, once the droplet 20 is ejected from the opening 18 in FIG. 2, the liquid holding unit 22 needs to be reset as in FIG. 1.

Second Embodiment

Figure 7:
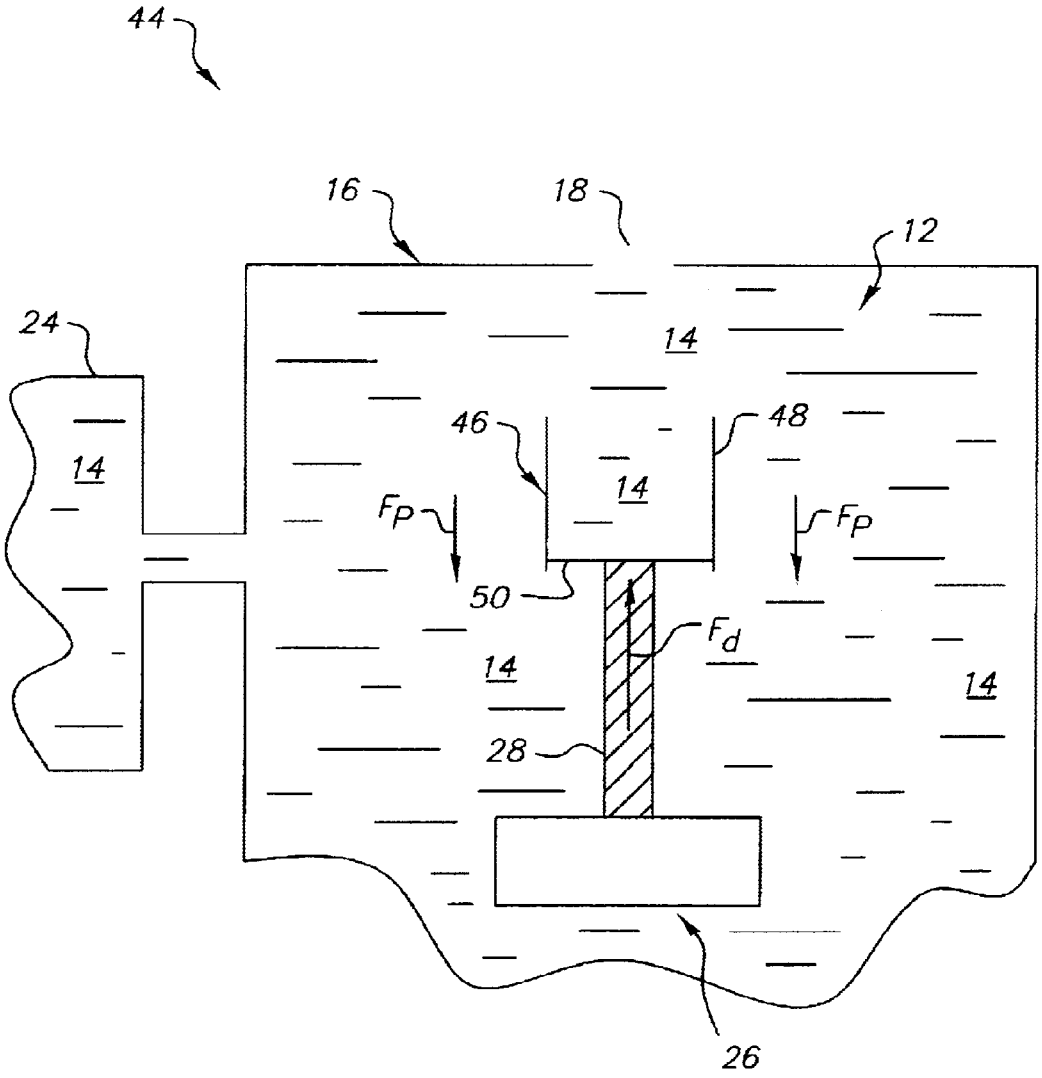
FIG. 7 is a cross-sectional view of a printing liquid droplet ejector according to another embodiment of the invention, in which the liquid holding unit has a bottom base that is displaceable relative to the remainder of the unit (rather than being deformed as in FIG. 2)
Figure 8:
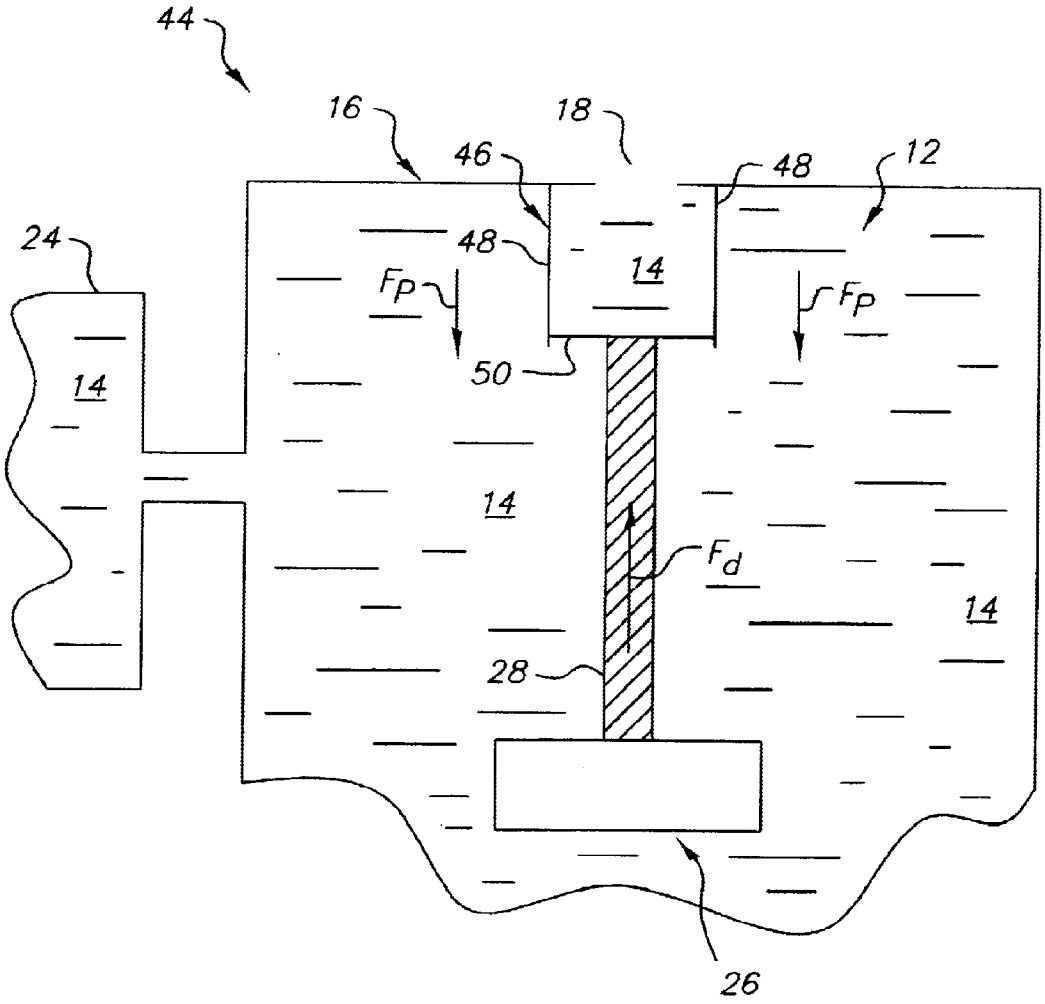
FIG. 8 is a cross-sectional view of the ejector in FIG. 7 at a time at which the liquid holding unit has been translated to touch the nozzle plate.
Figure 9A:
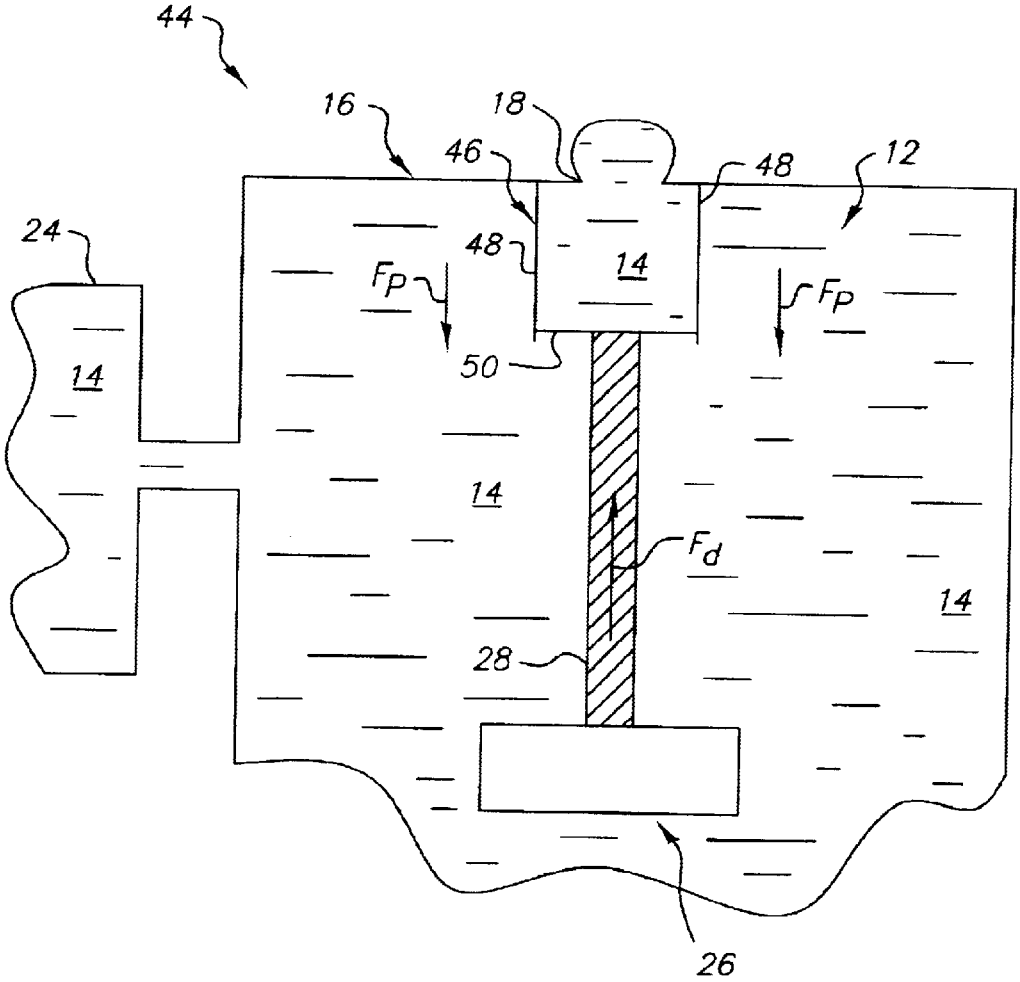
FIGS. 9*a* and 9*b* are cross-sectional views of the ejector in FIG. 7 at a time at which the bottom base has been displaced relative to the remainder of the unit.
Figure 9B:
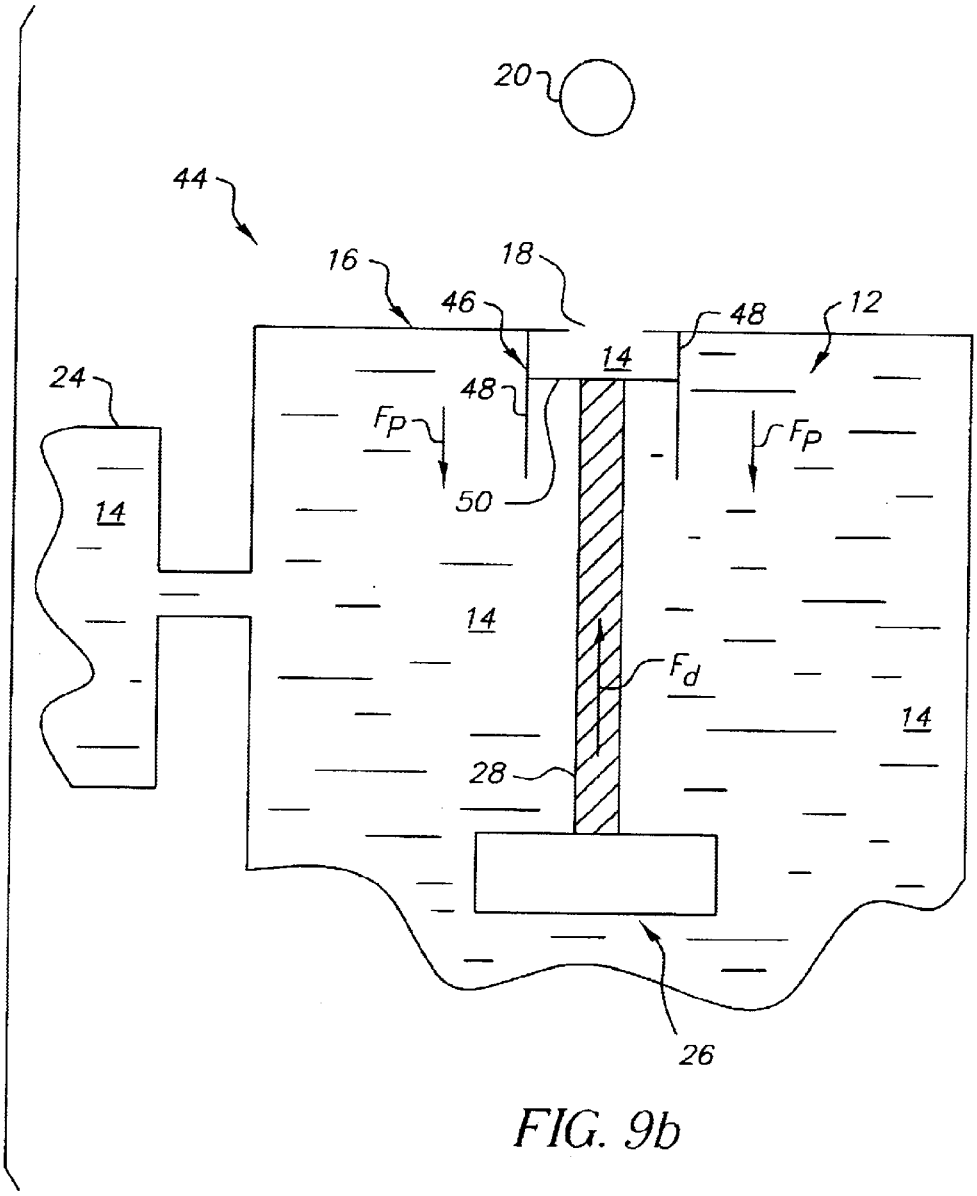

A second embodiment of an axisymmetric printing liquid droplet ejector 44 is shown in FIGS. 7–9*b*. The ejector 44 is the same as the ejector 10 in FIGS. 1 and 2, except that a liquid holding unit 46 includes a continuous sidewall 48 and a bottom component or piston 50 which is displaceable relative to the sidewall without changing the shape of the unit as shown in FIGS. 9*a* and 9*b*.

The bottom component or piston 50 is temporarily held fast to the sidewall 48 such as by a magnetic attraction between component 50 and a bottom portion of the sidewall 48, but is designed to be readily displaced vertically within the sidewall when a critical force Fc is transmitted along the sidewall to the bottom component similar to the description for FIG. 2. See FIGS. 8, 9*a* and 9*b*.

As viewed in FIGS. 7–9, the operation of the ejector 44 is as follows. Initially, a motive force $F_d$ is applied to the bottom component 50 as shown in FIG. 7. This causes the liquid holding unit 46 to be mechanically translated toward the nozzle plate 16 to eject a droplet 20 from the opening 18 as shown in FIG. 9*b*. The motive force $F_d$ can be applied by various means as stated before. When the liquid holding unit 46 moves to the nozzle plate 16, the top of the sidewall 48 comes into contact with the nozzle plate as shown in FIG. 8, and a force develops between the bottom component or piston 50 and the side wall 48 which causes the bottom component to begin to move relative to the sidewall as shown in FIGS. 9*a* and 9*b*. The interior volume 36 liquid holding unit 46 is progressively reduced within the sidewall 48 and the bottom component or piston 50 as shown in FIGS. 9*a* and 9B. To a good approximation, one can assume that the sidewall 48 remains in contact with the nozzle plate 16 when a droplet 20 is ejected from the opening 18. The volume flow rate $Q_0$ of the printing liquid that exits the opening 18 is $$Q_0=\pi R_b^2 v_b. \tag{12}$$

where $R_b$ and $v_b$ are the radius and velocity of the bottom component 50. From the conservation of mass, the velocity $v_o$ of the printing liquid that is ejected from the opening 18 is $$v_0 = \frac{\pi R_b^2}{\pi R_o^2} v_b. \tag{13}$$

Figure 10A:
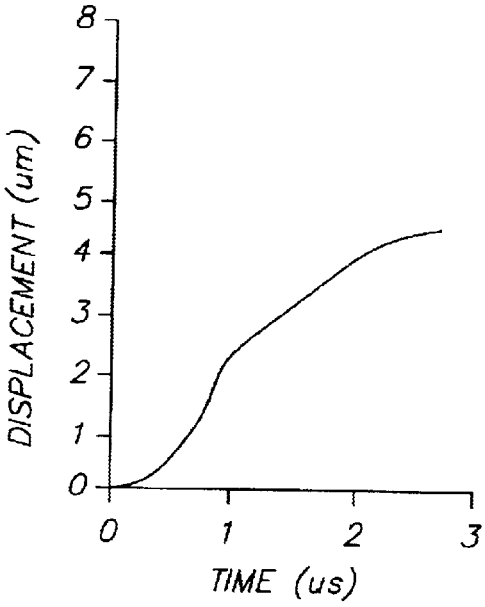
FIGS. 10*a–d* show model calculations of the displacement, velocity, and force $F_p$ (a–c) as a function of time for the ejector of FIGS. 1 and 2 as well as the velocity of the liquid moving through the opening as a function of time (d)
Figure 10B:
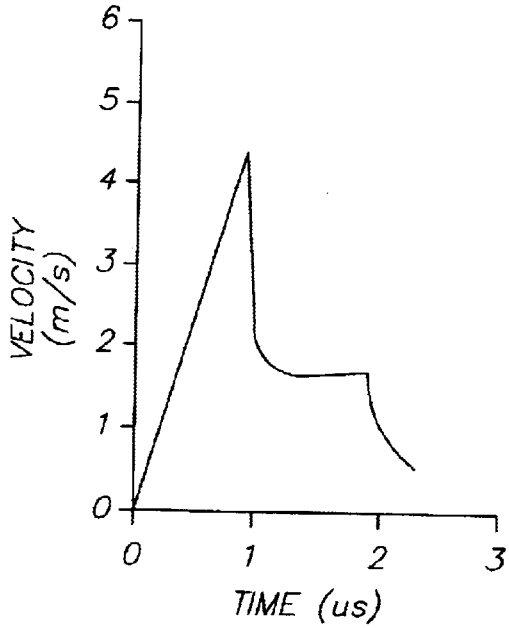
Figure 10C:
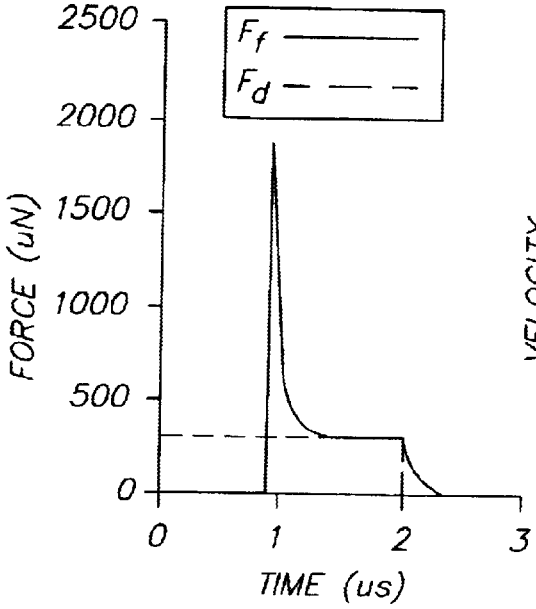
Figure 10D:
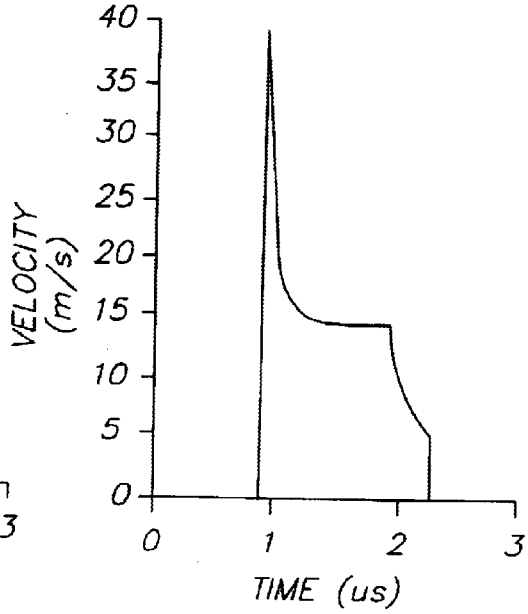

This velocity can be used to calculate the liquid pressure in the liquid holding unit 46 in a way similar to the description of the ejector 10. Calculations are shown in FIGS. 10*a*–10*c*, which depict the displacement and the velocity of the liquid holding unit 46, and the liquid force on the unit, as a function of time. FIG. 10*d* plots the velocity of the printing liquid moving through the opening 18 as a function of time.

Figure 11:
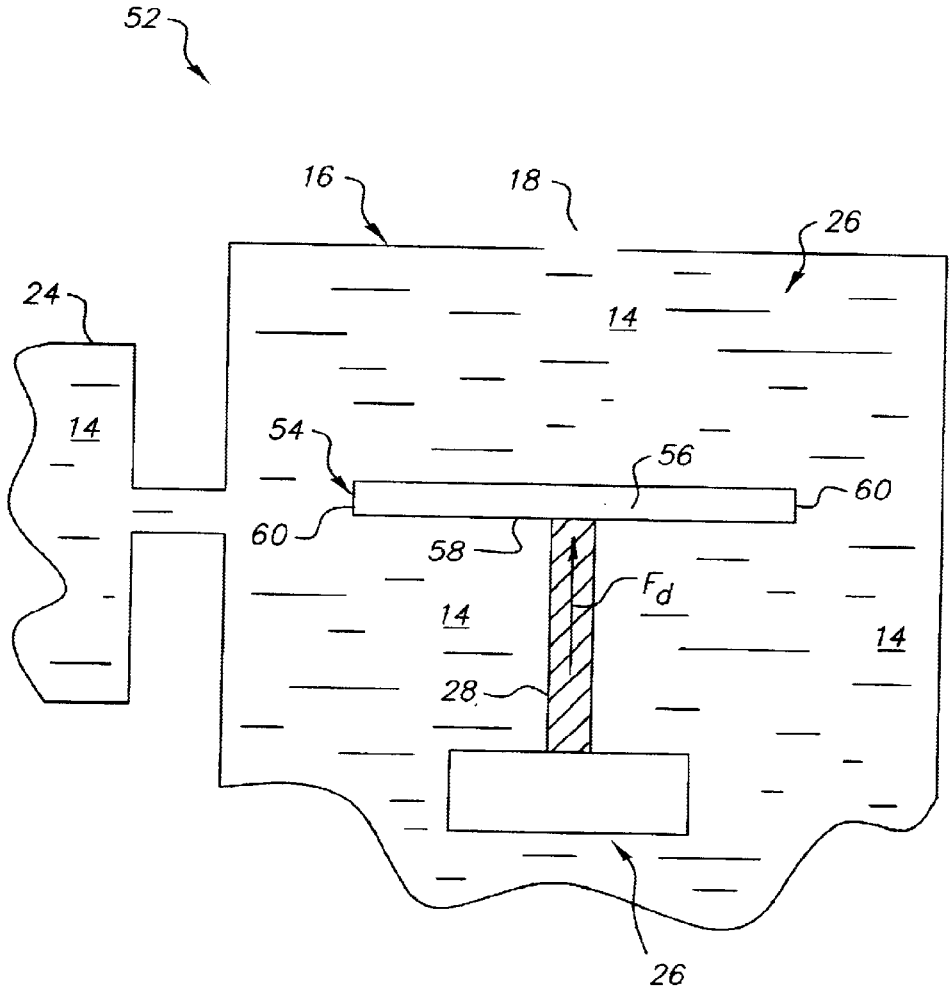
FIG. 11 is a cross-sectional view of a printing liquid ejector similar to the one in FIG. 7 except the bottom base is fixed at the top of the sidewalls (rather than being displaceable as in FIG. 9)
Figure 12A:
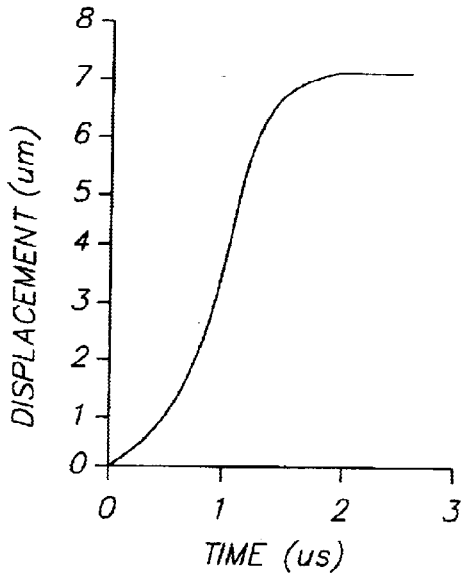
FIGS. 12*a–d* show model calculations of the displacement, velocity, and force $F_p$ (a–c) as a function of time for the ejector of FIG. 11 as well as the velocity of the liquid moving through the opening as a function of time(d)
Figure 12B:
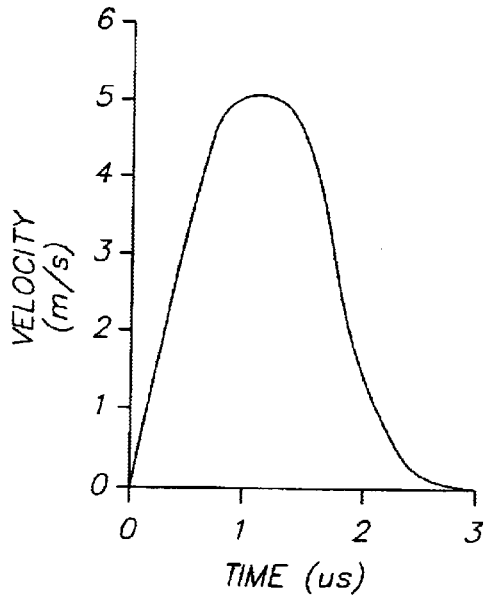
Figure 12C:
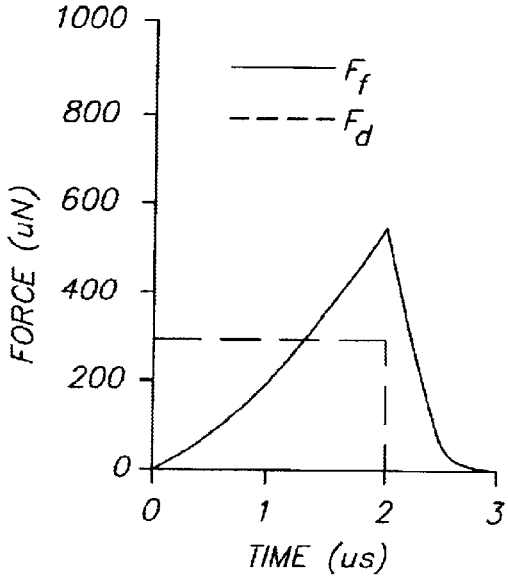
Figure 12D:
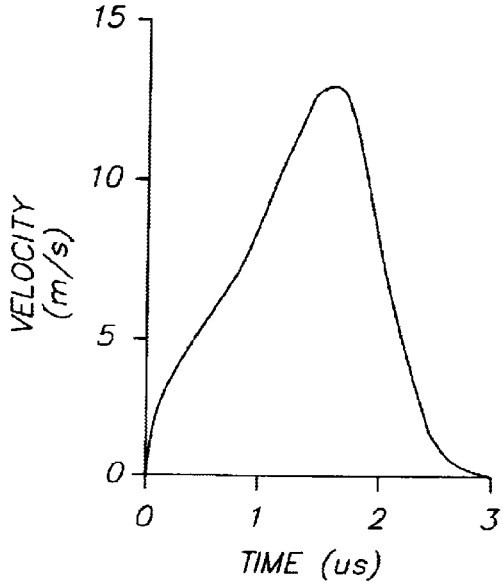

To compare the performance of the ejector 44 according the second embodiment with the performance of a known ejector 52 in FIG. 11, graphs analogous to those in FIGS. 10*a*–10*d* are shown in FIGS. 12*a*–12*d* for a known ejector 52 of FIG. 11. In FIG. 11, a single-piece liquid holding unit 54 is movable vertically in the cavity 12 and has a fixed non-alterable volume 56. In other words, a bottom base 58 cannot be moved relative to a continuous sidewall 60 (as distinguished from the bottom component or piston 50 in FIGS. 7–9*b*). The plots in FIGS. 12*a*–12*d* were obtained using the analysis described above for FIGS. 10*a*–10*d*. A constant motive force $F_d$ of 3 micro-Newtons was applied to both liquid holding units 46 and 54 for a duration of 2.0 $\mu$s. The original position of the liquid holding units was the same in both cases. The ejector 44 according to the second embodiment produced a droplet 20 with a volume of 6.72 picoliters and a velocity of 16.6 m/s, whereas the known ejector 54 produced a droplet with a volume of 5.0 picoliters and a velocity of 8.45 m/s. Moreover, the energy expended in ejecting the higher velocity droplet using the ejector 46 was less than half that expended using the known ejector 54.

Third Embodiment

Figure 13:
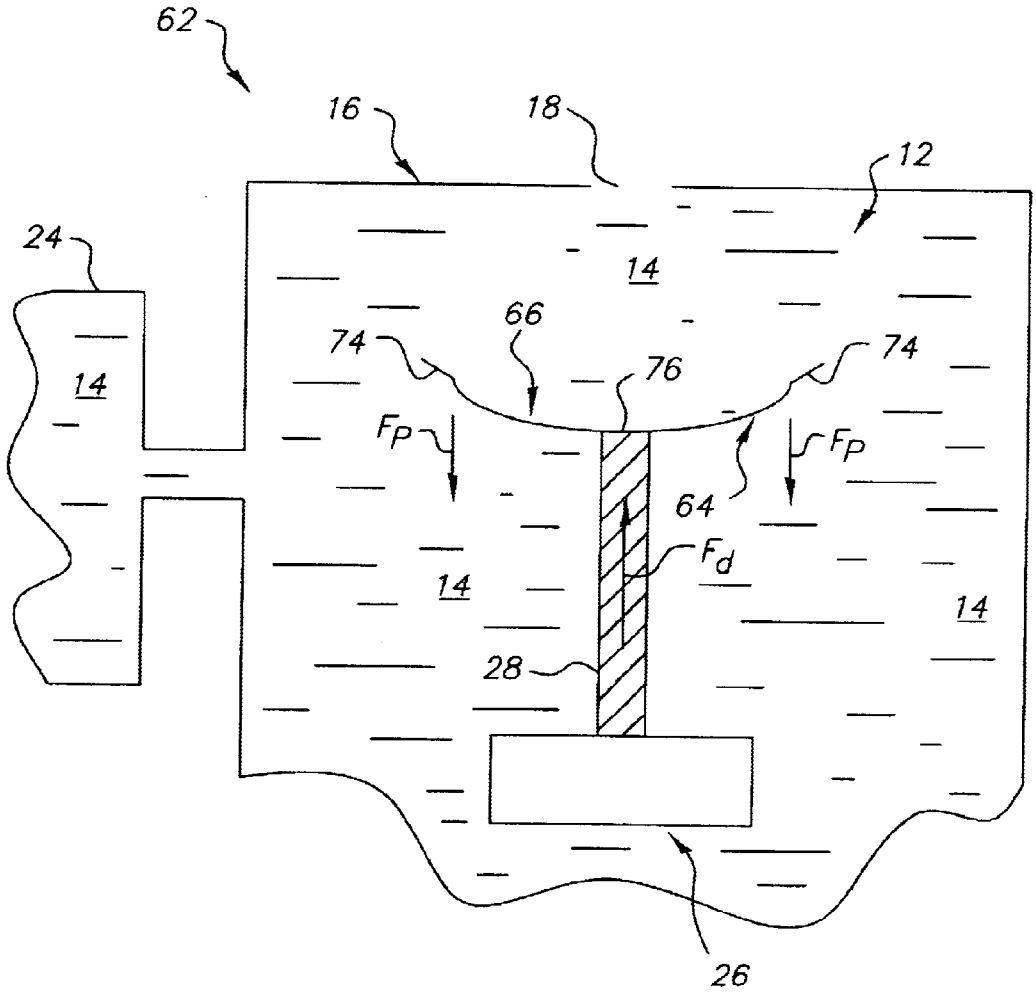
FIG. 13 is a cross-sectional view of a printing liquid droplet ejector according to another embodiment of the invention, in which the liquid holding unit is only a deformable dish-like diaphragm.
Figure 14:
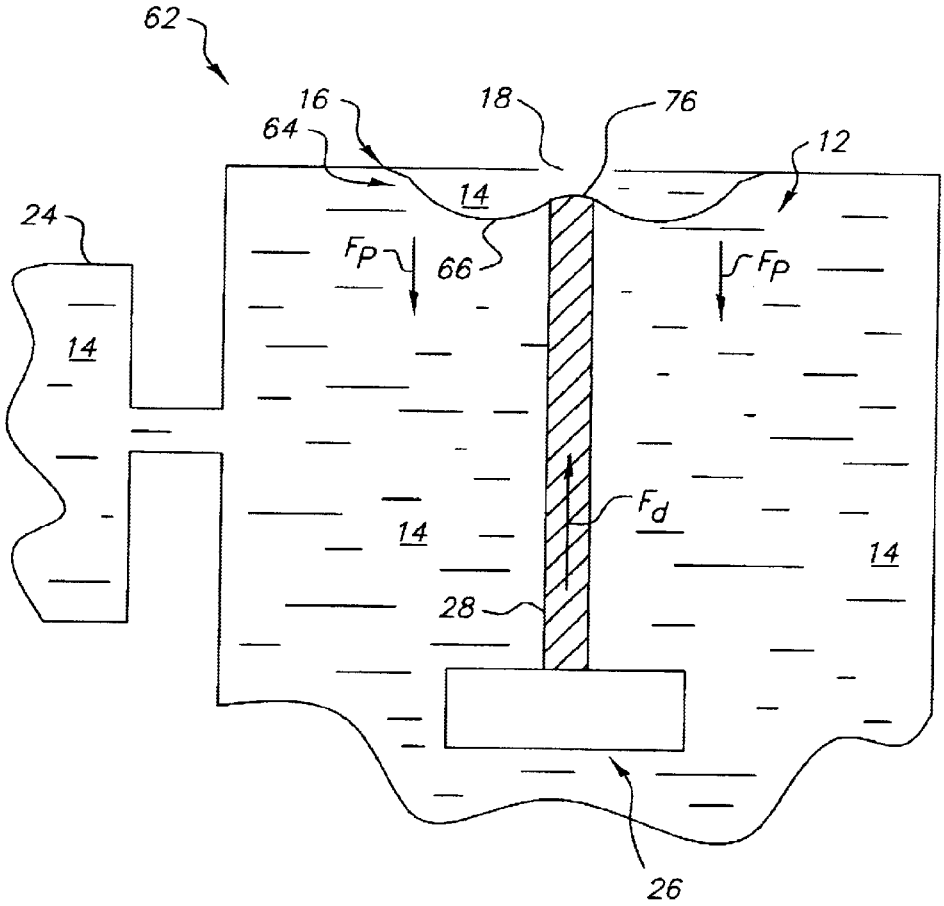
FIG. 14 is a cross-sectional view of the ejector in FIG. 13 in which the diaphragm is deformed from an original substantially convex exterior condition bulging-out as in FIG. 13 to a changed partially concave exterior condition bulging-in in part.

A third embodiment of an axisymmetric printing liquid ejector 62 is shown in FIGS. 13 and 14. The ejector 62 is the same as the ejector 10 in FIGS. 1 and 2, except that a liquid holding unit 64 is only a deformable dish-like diaphragm 66 (i.e. there is no additional sidewall). The diaphragm 66 is deformed from an original convex condition bulging out in FIG. 13 to a changed partly concave condition bulging in between dual convexes in FIG. 14. All other things are the same as in the preferred embodiment in FIGS. 1 and 2, including the bistable nature of the diaphragm.

As in the other embodiments, when the diaphragm 66 is deformed (to a changed partly concave condition bulging in between dual convexes in FIG. 14), a droplet 20 is ejected from the opening 18. However, in this case it is the interior volume only of the diaphragm 66 that is reduced upon deformation of the diaphragm (rather than the interior volume 36 in FIGS. 1 and 2, for example).

Figure 15:
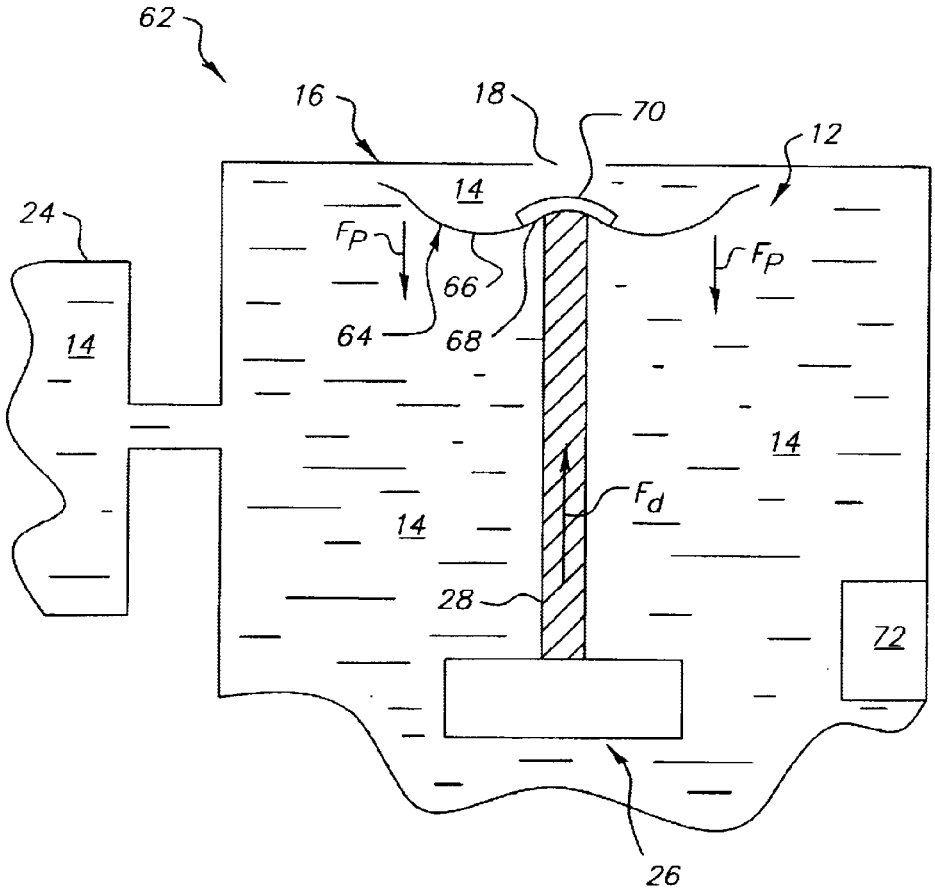
FIG. 15 is a cross-sectional view of the diaphragm in FIGS. 13 and 14, but varied so that a central portion has two layers with different coefficients of thermal expansion.

FIG. 15 shows a variant of the diaphragm 66 in FIGS. 13 and 14. The difference is that the diaphragm 66 in FIG. 15 has two layers 68 and 70 with different coefficients of thermal expansion so that one of the layers will expand more than the other when at least one of the layers is heated. This supplements the deformation of the diaphragm 66 from its original convex condition bulging out in FIG. 13 to a changed partly concave condition bulging in between dual convexes in FIGS. 14 and 15. A known heater 72 can directly heat one of the layers 68 and 70 or can heat the printing liquid 14 to in turn heat both of the layers.

Another variant (not shown) of the diaphragm 66 in FIG. 13 is that the diaphragm, rather than being deformed to a changed partly concave condition bulging in between dual convexes in FIG. 14, is deformed at least to partly collapse so that the diaphragm simply becomes less convex or even almost flat (not shown). In this case, the diaphragm 66 is deformed initially at an outer round perimeter 74 (in FIG. 13) when the perimeter is moved against the nozzle plate 16. This causes a torque along the perimeter 74 that deforms the diaphragm by collapsing at least a center 76 (in FIG. 13) of the diaphragm. In other words, the diaphragm 66 tends to begin to flatten so that the original convex condition bulging-out is simply made less convex. For this variant the diaphragm would only be resilient, and not bistable.

As in the other embodiments, when the diaphragm 66 is deformed to become less convex or even almost flat, a droplet 20 is ejected from the opening 18. However, in this case it is the interior volume only of the diaphragm that is reduced upon deformation of the diaphragm (rather than the interior volume 36 in FIGS. 1 and 2, for example).

While the invention has been described with respect to several embodiments and variants, persons of ordinary skill in the art will recognize that various additions and modifications of the invention might be made. For example, instead of the diaphragm 66 in FIG. 15 having the layers 68 and 70 with different coefficients of thermal expansion so that one of the layers will expand more than the other when at least one of the layers is heated, the layers can be replaced with any known means for accomplishing the same result, such as a piezo layers, etc. Also, the sidewall of the liquid holding unit could be replaced by a bellows, and neither the printing liquid droplet ejector nor its liquid holding unit need be axisymmetric.

10. Printing liquid droplet ejector (preferred embodiment)
12. Cavity
14. Printing liquid
16. Nozzle plate
18. Droplet ejection opening
20. Droplet
22. Liquid holding unit
24. Reservoir supplier
26. Force applying device
28. Pusher
30. Top plate
32. Bottom base
34. Sidewall
36. Interior alterable volume
38. Fill-line
40. Stratum
42. Curve
44. Printing liquid droplet ejector (second embodiment)
46. Liquid holding unit
48. Sidewall
50. Bottom component
52. Known ejector
54. Liquid holding unit
56. Non-alterable volume
58. Bottom base

60. Sidewall
62. Printing liquid droplet ejector (third embodiment)
64. Liquid holding unit
66. Diaphragm
68. Layer
70. Layer
72. Heater
74. Outer perimeter
76. Center

What is claimed is:

1. A printing liquid droplet ejector, comprising:

a cavity for containing a printing liquid;

a nozzle having a droplet ejection opening at said cavity;

a liquid holding unit in said cavity having a volume sufficient to hold some of the printing liquid in said cavity, being mechanically translatable toward said opening, and being volumetrically alterable to reduce its volume by having a component that is displaceable relative to the remainder of said unit to cause at least some of the printing liquid held by said unit to be expelled from said unit to in turn cause either printing liquid expelled from said unit or other printing liquid in said cavity to be ejected from said opening as at least one droplet when said unit is mechanically translated toward said opening; and a force applying device for applying a motive force to said liquid holding unit including to said component to mechanically translate the unit towards said opening and volumetrically alter said unit to reduce its volume by displacing said component relative to the reminder of said unit.

2. A printing liquid droplet ejector as recited in claim 1, wherein said liquid holding unit is volumetrically alterable to reduce its volume by being at least partially deformable from an original substantially convex exterior condition to a changed substantially concave exterior condition.

3. A printing liquid droplet ejector as recited in claim 1, wherein said liquid holding unit is volumetrically alterable to reduce its volume by being deformable only in part from an original substantially convex exterior condition to a changed substantially concave exterior condition so that another part of said unit remains in the original substantially convex condition.

4. A printing liquid droplet ejector as recited in claim 1, wherein said component that is displaceable relative to the remainder of said unit is displaceable without substantially changing the shape of said unit.

5. A printing liquid droplet ejector as recited in claim 1, wherein said liquid holding unit is alterable to reduce its volume by being deformable axisymmetrically.

6. A printing liquid droplet ejector as recited in claim 1, wherein said liquid holding unit is alterable to reduce its volume by being bistable to change from a mechanically stable greater-volume concave configuration to a mechanically stable lesser-volume convex configuration.

7. A printing liquid droplet ejector as recited in claim 1, wherein said nozzle includes a plate having said opening, and said liquid holding unit is a diaphragm alterable to reduce its volume by being deformed substantially against said plate and over said opening.

8. A printing liquid droplet ejector as recited in claim 7, wherein said diaphragm is deformed substantially against said plate only at an outer perimeter of said diaphragm to cause a torque along said perimeter that deforms said diaphragm to reduce its volume by collapsing at least a center of said diaphragm over said opening.

9. A printing liquid droplet ejector as recited in claim 1, wherein said nozzle includes a plate having said opening, and said liquid holding unit is a diaphragm alterable to reduce its volume by being deformed substantially over said opening and against a stratum of printing liquid between said plate and said diaphragm.

10. A printing liquid droplet ejector as recited in claim 1, wherein said liquid holding unit has two layers with different coefficients of thermal expansion so that one of said layers will expand more than the other to volumetrically alter said unit to reduce its volume when at least one of said layers is heated, and a heater heats at least one of said layers in addition to said force applying device applying said motive force to said liquid holding unit to also alter said unit to reduce its volume.

11. A printing liquid droplet ejector as recited in claim 10, wherein said heater heats the printing liquid in said cavity directly to in turn heat said layers.

12. A printing liquid droplet ejector as recited in claim 10, wherein said heater directly heats at least one of said layers.

13. A printing liquid droplet ejector as recited in claim 1, wherein said liquid holding unit includes a sidewall and a bottom base that together define the volume of said unit that is reduced to cause at least some of the printing liquid held by said unit to be expelled from said unit.

14. A printing liquid droplet ejector as recited in claim 13, wherein said bottom base is deformable to reduce the volume of said liquid holding unit.

15. A printing liquid droplet ejector as recited in claim 13, wherein said bottom base is displaceable relative to said sidewall to reduce the volume of said liquid holding unit.

16. A method of ejecting printing liquid as one or more droplets using a liquid holding unit that is volumetrically alterable to reduce its volume to expel a printing liquid held by the unit, said method comprising:

placing a printing liquid into a cavity including a nozzle having a droplet ejection opening; and applying a motive force to the liquid holding unit in the cavity to mechanically translate the unit towards the opening and, when the unit is at least close to the opening, to volumetrically alter the unit to reduce its volume, by applying the motive force to a displaceable component of the liquid holding unit to displace the component relative to the remainder of the unit, so that either printing liquid expelled from the unit or other printing liquid in the cavity is ejected from the opening as at least one droplet.

17. A method as recited in claim 16, wherein the liquid holding unit is volumetrically altered to reduce its volume by applying the motive force to at least partially deform the unit from an original substantially convex exterior condition to a changed substantially concave exterior condition.

18. A method as recited in claim 17, wherein the displaceable component of the liquid holding unit that is displaceable relative to the remainder of the unit is displaceable without substantially changing the shape of the unit.

* * * * *